US010233635B2

(12) United States Patent
Vehniäinen

(10) Patent No.: US 10,233,635 B2
(45) Date of Patent: Mar. 19, 2019

(54) TEMPORARY WALL ELEMENT

(71) Applicant: DS Product Service Limited, London (GB)

(72) Inventor: Joni Vehniäinen, Helsinki (FI)

(73) Assignee: DS PRODUCT SERVICE LIMITED, London (GB)

( * ) Notice: Subject to any disclaimer, the term of this patent is extended or adjusted under 35 U.S.C. 154(b) by 0 days.

(21) Appl. No.: 15/111,425

(22) PCT Filed: Jan. 14, 2015

(86) PCT No.: PCT/FI2015/050018
§ 371 (c)(1),
(2) Date: Jul. 13, 2016

(87) PCT Pub. No.: WO2015/107265
PCT Pub. Date: Jul. 23, 2015

(65) Prior Publication Data

US 2016/0333580 A1 Nov. 17, 2016

(30) Foreign Application Priority Data

Jan. 15, 2014 (FI) ..... 20145025

(51) Int. Cl.
*E04B 2/82* (2006.01)
*E04G 21/24* (2006.01)
(Continued)

(52) U.S. Cl.
CPC ..... *E04B 2/821* (2013.01); *E04B 1/6801* (2013.01); *E04B 2/721* (2013.01); *E04B 2/828* (2013.01); *E04G 21/24* (2013.01); *E04G 21/28* (2013.01)

(58) Field of Classification Search
CPC ..... E04H 17/16; E04G 21/32; E04G 21/24; E04G 21/28; E04G 21/243; E04B 2/821; E04B 1/6801; E04B 2/721; E04B 2/828
(Continued)

(56) References Cited

U.S. PATENT DOCUMENTS 3,195,191 A * 7/1965 Neisewander ..... E04B 2/822 49/320
3,292,321 A * 12/1966 Vander Schans ..... E04B 2/822 52/241
(Continued)

FOREIGN PATENT DOCUMENTS

AU 2012201848 A1 10/2013
CA 962423 A 2/1975
(Continued)

OTHER PUBLICATIONS

Aug. 15, 2014 Search Report issued in Finnish Patent Application No. 20145025.
(Continued)

*Primary Examiner* — Beth A Stephan
(74) *Attorney, Agent, or Firm* — Oliff PLC

(57) ABSTRACT

A wall element having two sets of columns with panel between the columns so that the columns of the first set and the second set are within each other so that the wall element can be extended and contracted, depending on the room height, in such a way that the wall panels cover the area between columns and form a substantially continuous wall from floor to ceiling.

10 Claims, 5 Drawing Sheets

(51) Int. Cl.
*E04G 21/28* (2006.01)
*E04B 1/68* (2006.01)
*E04B 2/72* (2006.01)

(58) Field of Classification Search
USPC ..... 52/243.1
See application file for complete search history.

(56) References Cited

U.S. PATENT DOCUMENTS 3,453,790 A * 7/1969 Harris ..... E04B 2/821 52/126.3
3,897,668 A * 8/1975 McDonnell ..... E04B 2/822 248/200.1
4,037,380 A * 7/1977 Pollock ..... E04B 2/824 52/126.4
4,731,961 A * 3/1988 Bona ..... E04B 2/82 135/142
4,841,689 A * 6/1989 Schussler ..... E04B 2/827 160/197
5,140,792 A * 8/1992 Daw ..... E04B 2/7409 52/238.1
5,433,046 A * 7/1995 MacQuarrie ..... E04B 2/7422 52/238.1
5,685,121 A * 11/1997 DeFrancesco ..... E04C 3/07 52/241
6,050,045 A * 4/2000 Campbell ..... E04B 1/3441 52/126.6
6,119,430 A * 9/2000 Nicholls ..... E02D 29/02 52/118
6,612,670 B2 * 9/2003 Liu ..... A47G 5/00 160/351
2005/0247414 A1 11/2005 Whittemore
2007/0113991 A1 5/2007 Mangelsen et al.
2012/0273140 A1 11/2012 Morales

FOREIGN PATENT DOCUMENTS

DE 19856542 A1 6/2000
EP 0034827 A1 9/1981
FR 2872532 A1 1/2006
JP 2003/013607 A 1/2003
WO WO 0120105 A1 * 3/2001 ..... E01F 13/022
WO 2007/102015 A1 9/2007
WO 2009/116466 A1 9/2009

OTHER PUBLICATIONS

May 12, 2015 International Search Report issued in International Patent Application No. PCT/FI2015/050018.
May 12, 2015 Written Opinion of the International Searching Authority issued in International Patent Application No. PCT/FI2015/050018.

* cited by examiner

TEMPORARY WALL ELEMENT

FIELD OF THE INVENTION

The present invention relates to weather protection and isolation of buildings during construction time and particularly to a temporary wall element.

BACKGROUND OF THE INVENTION

In a typical building site of a multi-storey apartment or office building the building frame is erected first and exterior walls are constructed later on. Especially in tall buildings the building frame can be without exterior walls for a long time in the top-most floors which are also subject to harsh weather conditions.

Typical solution is to fix a plank to a floor and to a ceiling and stretch a sheet of plastic between them to keep most of the rain and the wind outside. In upper floors a parapet or a balustrade is also needed to prevent workmen from falling down and injuring themselves.

One of the problems associated with the above arrangement is that these arrangements are burdensome to build and demolish. Heat and sound insulation are poor and during wintertime a constant room temperature is difficult to arrange into such a building site which means that temperature-sensitive indoor work can't be started before the exterior walls have been built.

BRIEF DESCRIPTION OF THE INVENTION

An object of the present invention is thus to provide an arrangement so as to alleviate the above disadvantages. The objects of the invention are achieved by an arrangement which is characterized by what is stated in the independent claim. The preferred embodiments of the invention are disclosed in the dependent claims.

The invention is based on the idea of a wall element having two sets of columns with panel between the columns so that the columns of the first set and the second set are within each other so that the wall element can be extended and contracted, depending on the room height, in such a way that the wall panels cover the area between columns and form a substantially continuous wall from floor to ceiling.

An advantage of the wall element of the invention is that a temporary wall can be erected quickly and easily to arbitrary room with a number of wall elements without needing any tools. The wall elements are reusable and the wall panels can be changed if better insulation, lighter weight or other properties are desired.

BRIEF DESCRIPTION OF THE DRAWINGS

In the following the invention will be described in greater detail by means of preferred embodiments with reference to the accompanying drawings, in which.

DETAILED DESCRIPTION OF THE INVENTION

Figure 1:
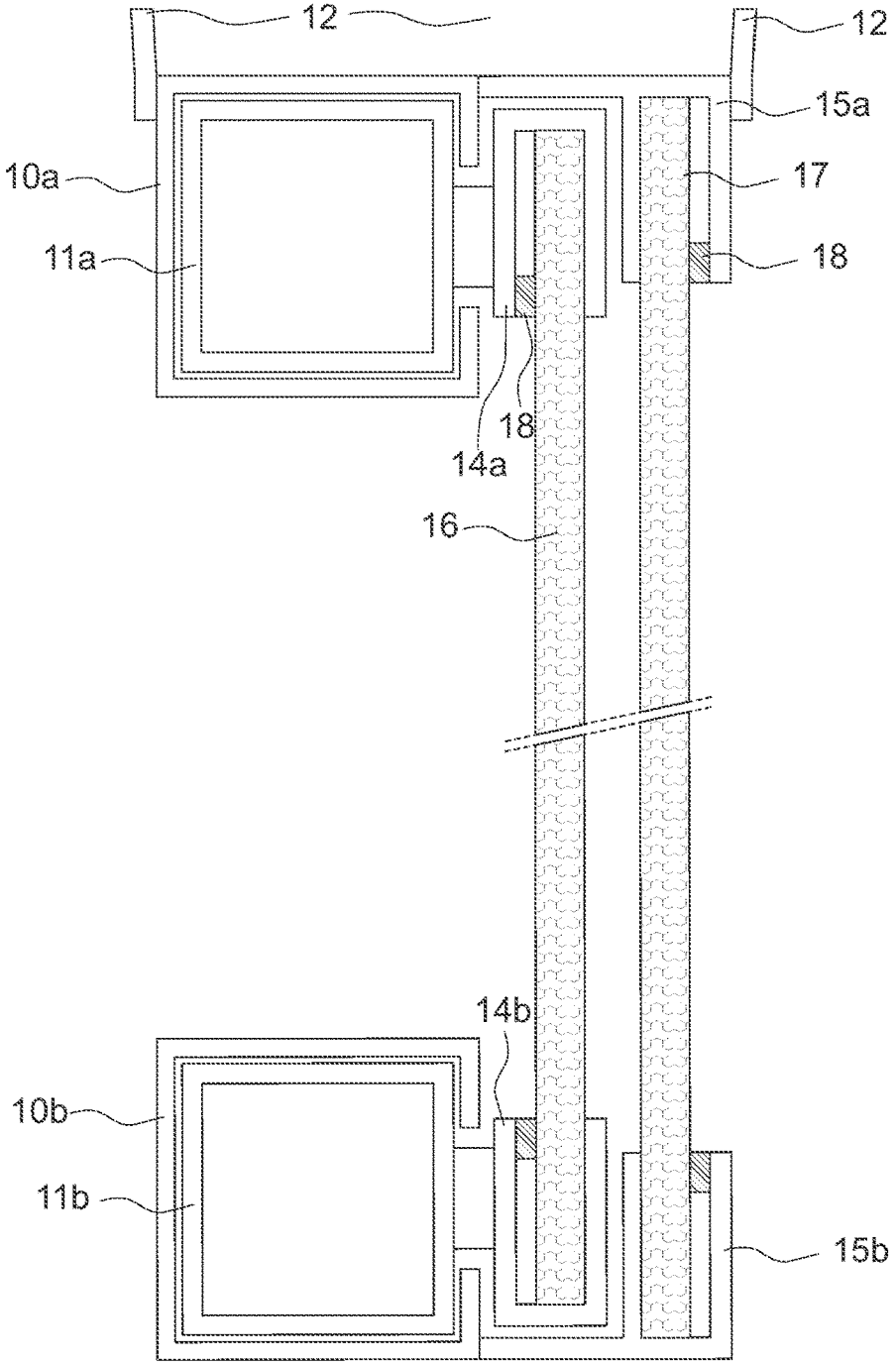
FIG. 1 illustrates a cross-section of a wall element according to an embodiment of the invention.
Figure 2:
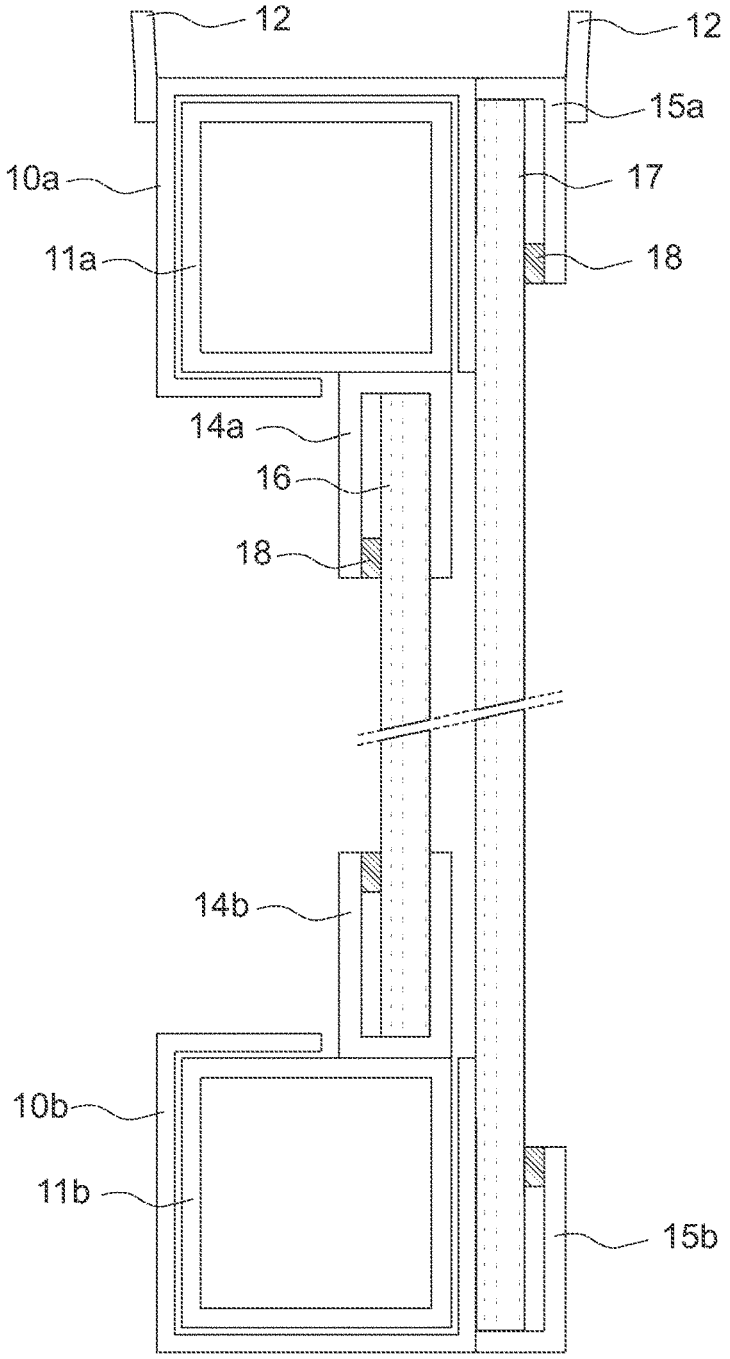
FIG. 2 illustrates a cross-section of a wall element according to an embodiment of the invention.
Figure 3:
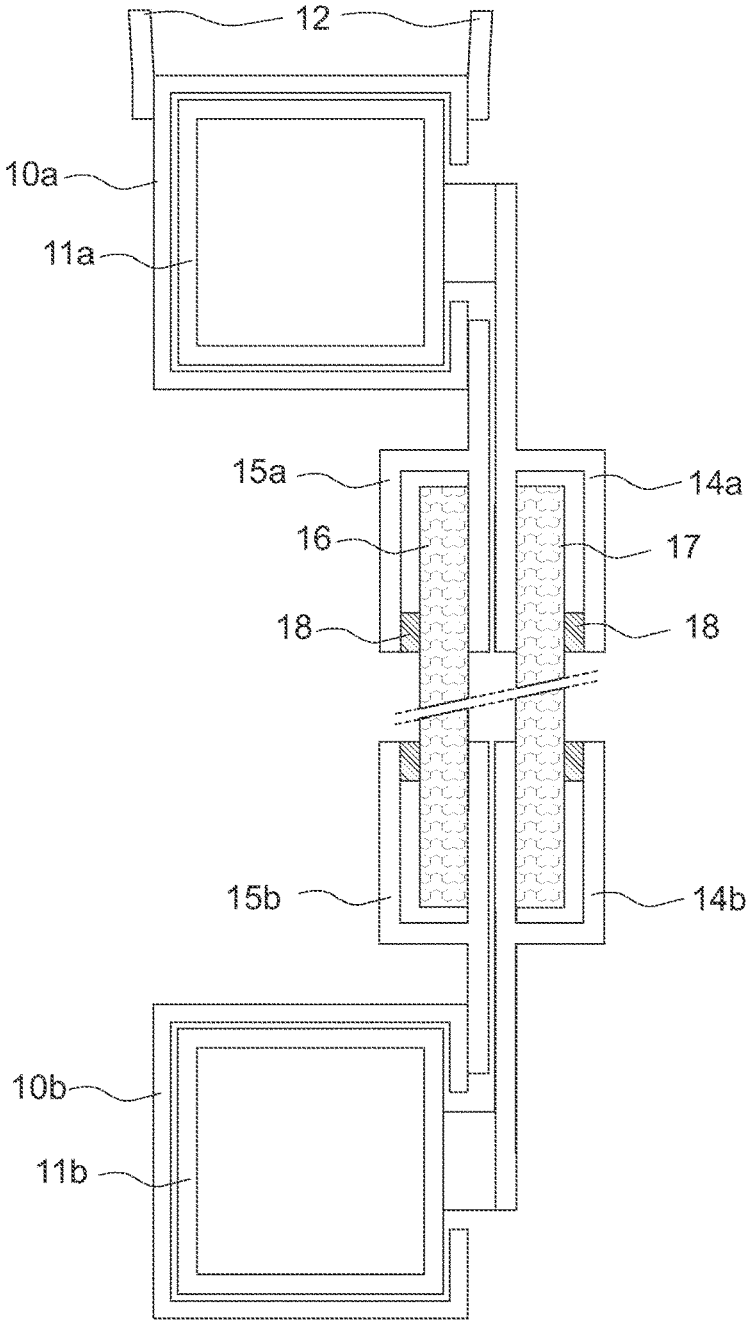
FIG. 3 illustrates a cross-section of a wall element according to an embodiment of the invention.

FIGS. 1, 2 and 3 illustrate various designs of a wall element according to embodiments of the invention. The wall element is suitable for temporary isolation of a building site such as a frame of a multi-storey building without its exterior face. The wall element can be used for erecting a wall between the floors of the building frame and protecting the inside of the building from weather thus enabling early start for indoor construction work. Once the exterior walls have been installed, the wall elements are removed and the indoor work can be finished. The temporary wall elements can be reused in the next building site.

The wall element of FIG. 1 has two inner columns 11*a*, 11*b* which can be for example in the form of a rectangular pipe such as a square pipe. When the wall element is in use, the inner columns 11*a*, 11*b* are in vertical position in longitudinal direction pointing from a floor to a ceiling or vice versa. The inner columns are near the horizontal ends i.e. sides of the wall element. The columns are preferably made of metal, such as aluminium or steel, or plastics, such as polycarbonate. In an embodiment the columns are not pipes but profiles providing enough strength to the column structure.

Both inner columns 11*a*, 11*b* have a fixed support 14*a*, 14*b* for holding a wall panel. The fixed support is preferably a continuous profile extending along the inner column for substantially the whole length of the inner column. The fixed support has preferably a slot or a cavity for housing an edge of a wall panel. In an embodiment the fixed support is arranged to house wall panels of different thicknesses wherein gaskets 18 are arranged between the fixed supports and the wall panels to secure the wall panel to the fixed support.

The wall element also has a first wall panel 16 arranged between the fixed supports 14*a*, 14*b*. The wall panel is preferably made of cellular or honeycomb board to reduce weight and improve insulation. In an embodiment the wall panel is a polycarbonate cellular board. In an embodiment the wall panel has a thickness between 6 and 32 millimeters. In an embodiment the wall panel has a thickness up to 40 millimeters. In an embodiment the wall panel has a thickness from 12 millimeters.

The wall element comprises also two outer columns 10*a*, 10*b* partially surrounding the two inner columns 11*a*, 11*b*. The outer columns can be for example in the form of the letter C or a rectangular pipe with one side cut open. It is important that the inner columns 11*a*, 11*b* fit inside the outer columns 10*a*, 10*b*, though not necessarily length-wise. When the wall element is in use, the inner columns 11*a*, 11*b* and the outer columns 10*a*, 10*b* are in vertical position in longitudinal direction pointing from a floor to a ceiling or vice versa. The inner columns and outer columns are near the horizontal ends i.e. sides of the wall element. The columns are preferably made of metal, such as aluminium or steel, or plastics, such as polycarbonate. In an embodiment the columns are not pipes but profiles providing enough strength to the column structure.

Like the inner columns, also both outer columns 10*a*, 10*b* have a fixed support 15*a*, 15*b* for holding a wall panel. The fixed support is preferably a continuous profile extending along the outer column for substantially the whole length of the inner column. The fixed support has preferably a slot or a cavity for housing an edge of a wall panel. In an embodiment the fixed support is arranged to house wall panels of different thicknesses wherein gaskets 18 are arranged between the fixed supports and the wall panels to secure the wall panel to the fixed support.

Finally the wall element has a second wall panel 17 arranged between the fixed supports 15*a*, 15*b* of the outer columns. The wall panel is preferably made of cellular or honeycomb board to reduce weight and improve insulation. In an embodiment the wall panel is a polycarbonate cellular board. In an embodiment the wall panel has a thickness between 6 and 32 millimeters. In an embodiment the wall panel has a thickness up to 40 millimeters. In an embodiment the wall panel has a thickness from 12 millimeters.

The wall element can be extended and contracted depending on the room height where the wall element is used. The two inner columns 11*a*, 11*b* and the two outer columns 10*a*, 10*b* are at least partially within each other and configured to be moved relative to each other in the longitudinal direction of the columns 10*a*, 10*b*, 11*a*, 11*b* so as to adjust the length of the wall element to match the room height of the building site to be isolated. In an embodiment the wall element comprises at least one spring which is arranged to exert a force between the two inner columns 11*a*, 11*b* and the two outer columns 10*a*, 10*b* to move them relative to each other in the longitudinal direction of the columns 10*a*, 10*b*, 11*a*, 11*b* so as to secure the wall element between a floor and a ceiling. Preferably the wall element comprises a spring between each inner column and outer column so that the spring is loaded when the wall element is pushed in to its contracted state and locked in the contracted state. When released, the spring force extends the wall element and pushes opposing ends of the wall element against the floor and the ceiling. In an embodiment the wall element comprises a non-slip surface on the outer surfaces which are arranged to be placed against the floor or the ceiling. The non-slip surface may be for example corrugated rubber or silicone.

The first wall panel 16 and the second wall panel 17 are preferably close to each other when the wall element is in its contracted state. When the wall element is extended, the first wall panel 16 and the second wall panel 17 form a substantially even vertical wall with a small discontinuation and a gap between the wall panels. If a maximum insulation and/or air tightness is important the gap between the wall panels can be covered with e.g. a sticky tape. In an embodiment the gap between the wall panels 16, 17 has been made dust proof by using a felt gasket or felt seal. The felt gasket or seal is compressible but does not provide as much friction as rubber gaskets and seals and thereby allows the wall panels to slide against the felt gasket. The felt gasket is preferably fixed to the first wall panel 16 on the side that is facing the second wall panel 17 or to the second wall panel 17 on the side that is facing the first wall panel 16.

In an embodiment the wall elements are used in renovation sites to define a 'clean room' and a 'dirty room'. While the renovation work is being done at the dirty room, normal living conditions should be maintained at the clean room which is on the other side of a temporary wall made of wall elements. Thus it is vital that the temporary wall is at least essentially dust proof so that the dust caused by the renovation or construction work does not spread to the clean room. In addition to the seals which seal the wall panels and essentially the wall element by itself, additional seals and gaskets are needed to seal the outer periphery of the wall element. A sealing gasket is applied on the top and bottom surfaces of the wall element for dust proof seal. In an embodiment the non-slip surface on the top and bottom of the wall element is applied on the whole upper and lower surface of the wall element so that the non-slip surface itself provides for a dust proof seal between both the wall element and the floor, and the wall element and the ceiling. Furthermore, the sides of the wall element which are against neighbouring wall elements need to be sealed to prevent leaking between two wall elements. Preferably a continuous sealing gasket runs through the whole length from floor to ceiling on at least one side of the wall element so that the sealing gasket seals any small gaps between two neighbouring wall elements.

Occasionally people, tools or materials have to be moved through temporary walls during renovation or construction. In an embodiment one or more wall elements or a temporary wall can be equipped with a hatch or a door. Said hatch or door may be e.g. hinged to the lower wall panel, e.g. the first wall panel 16. The wall element which has a door may need to be wider than other wall panels, e.g. 1200 mm wide instead of 600 mm or 900 mm. Also the upper wall panel, e.g. the second wall panel 17, may need to be cut to a lower height than in normal wall panels so that it wouldn't lower the doorway too much in sites with low room height. Since the wall panels are interchangeable, only the second wall panel 17 needs to be changed if the room height changes significantly between sites which will use the same door element.

In an embodiment the wall element comprises a guide 12 for partially accommodating a column of similar neighbouring wall element. The guide may comprise for example protrusions extending along both sides of column 10*a* so that the column 10*b* of the neighbouring wall element can be placed between the protrusions so as to obtain a continuous wall from multiple neighbouring wall elements. Also other suitable guides can be used.

Figure 4:
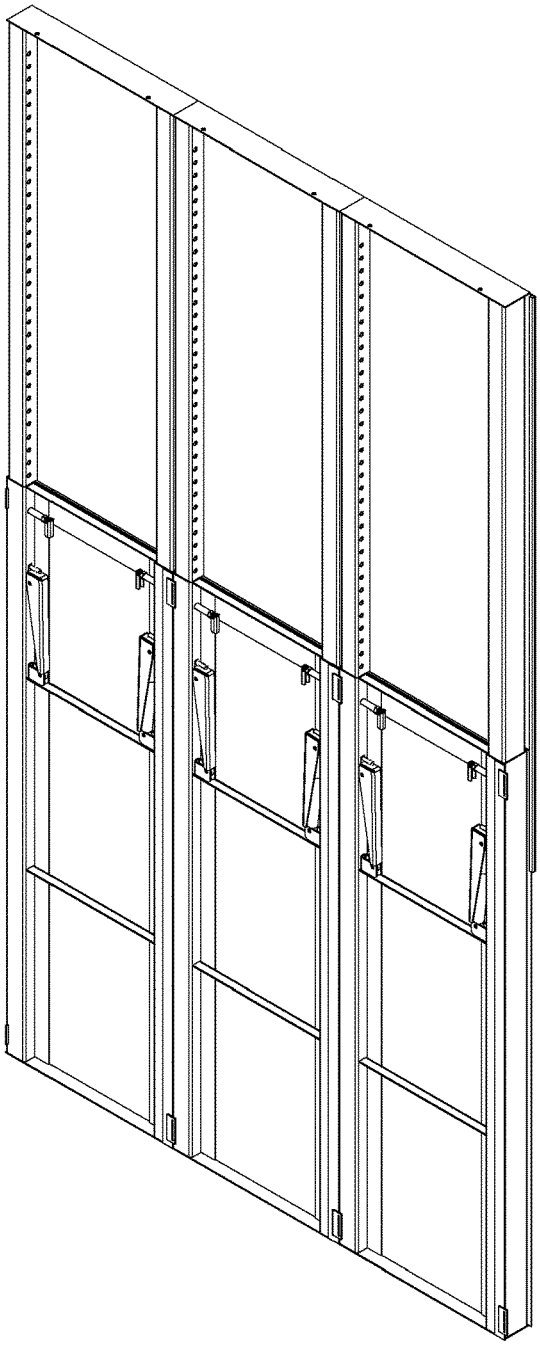
FIG. 4 illustrates a perspective view of a temporary wall comprising three wall elements.

FIG. 4 illustrates a temporary wall which can be erected with a three wall elements without using any tools. The wall elements are locked to neighbouring wall elements with guides 12 and extended between the floor and the ceiling to fasten the wall element in place. The wall elements are reusable and the wall panels can be changed if better insulation, lighter weight or other properties are desired. The temporary wall erected with the wall elements can be designed to fill work safety requirements for construction sites. The temporary wall can be easily modified to withstand a concentrated load of 1000 N which in some countries is a part of a work safety requirement. The load bearing capability can be increased with e.g. horizontal pipes fixed to the wall element at 600 mm and 1200 mm heights from the bottom.

Figure 5:
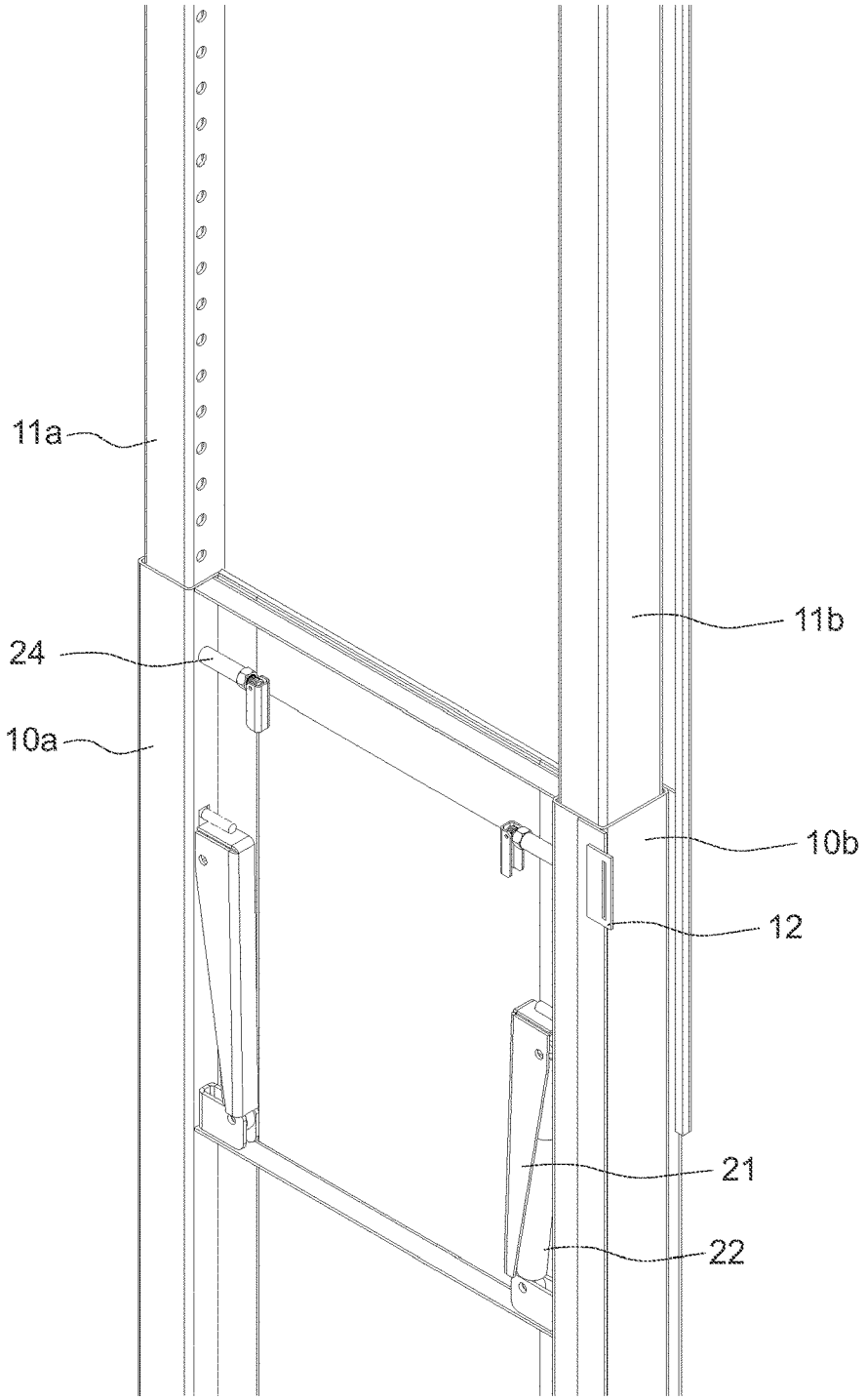
FIG. 5 illustrates a detail of a wall element according to an embodiment of the invention.

FIG. 5 shows a height adjusting mechanism of a wall element according to an embodiment of the invention. The wall element can be extended and contracted using the height adjusting mechanism. The two inner columns 11*a*, 11*b* have apertures or recesses which are preferably spaced equally e.g. every 3, 4 or 5 centimeters. The two outer columns 10*a*, 10*b* surround at least partially the two inner columns 11*a*, 11*b*, respectively. The columns are configured to be moved relative to each other in the longitudinal direction of the columns 10*a*, 10*b*, 11*a*, 11*b* so as to adjust the length of the wall element. The two outer columns both have a pin 24 which is configured to be partially accommodated in one of the apertures or recesses of the inner column. The pins 24 are preferably spring loaded so that the pin pushes against the surface of the inner column when the pin is not accommodated in any of the apertures or recesses. The pins 24 have preferably a bevel on one side of the end which accommodates the aperture or recess. The bevelled end of the pin makes quick height adjustment possible in one direction depending on the position of the pin. For example, if the bevelled side of the pin faces towards a floor, the wall element can be extended by simply pulling the inner columns out of the outer columns and the pins just slide from one aperture to another because the bevelled side of the pin is pushed against the edge of the aperture. If the wall element is contracted by pushing the inner columns back inside the outer columns, the pins have to be manually pulled out of the apertures because now straight sides of the pins are being pushed against the edges of the apertures so the pins will not slide out from the apertures. By turning the pin 180 degrees so that the bevelled side of the pins face a ceiling, contracting of the wall element is as easy as extending of the wall element described earlier.

The pin and aperture adjustment is not accurate enough to match the room height of the building site to be isolated. It can be used to extend the height of the wall element until the wall element is a few centimeters shorter than the room height. The remaining adjustment and a force that pushes the wall element against the floor and the ceiling are achieved with a spring arrangement. The spring arrangement is arranged to exert a force between the two inner columns 11*a*, 11*b* and the two outer columns 10*a*, 10*b* to move them relative to each other in the longitudinal direction of the columns 10*a*, 10*b*, 11*a*, 11*b* so as to secure the wall element between a floor and a ceiling.

In the embodiment of FIG. 5, the wall element comprises a pneumatic spring 22 between both inner column and outer column pairs. The pneumatic spring 22 is operated with a lever 21. The pneumatic spring can be extended by releasing it with the lever 21. When released, the spring force extends the wall element and pushes opposing ends of the wall element against the floor and the ceiling. When the wall element is to be removed, the lever 21 can be pushed back in to contract the pneumatic spring 22 and release the spring force that fastens the wall element between the floor and the ceiling. Both tension and compression springs can be used and also other spring types than just pneumatic springs are possible, e.g. helical or coil springs can be used as well.

In an embodiment the wall element comprises a non-slip surface on the end surfaces of the wall element which are arranged to be placed against the floor or the ceiling. The non-slip surface may be for example corrugated rubber or silicone. The non-slip surface may extend, in the floor end of the wall element, along the floor over the edge of the floor in a construction site when the wall elements are used as exterior wall during construction. The extending non-slip surface guides wind-blown rain water out of the floor which is typically a concrete slab in multi-storey buildings. In an embodiment a separate rubber flap is fixed to the lower part of the wall element instead of extending the non-slip surface. The flap guides any unwanted water outside the building just like the extended non-slip surface described earlier. The flap can also be made of other materials than rubber, for example silicone and plastics can be used as well. The flap and/or the extended non-slip surface help to keep the concrete slab dry and to prevent unwanted accumulation of rainwater on the periphery of the building.

It will be obvious to a person skilled in the art that, as the technology advances, the inventive concept can be implemented in various ways. The invention and its embodiments are not limited to the examples described above but may vary within the scope of the claims.

The invention claimed is:

1. A wall element for temporary isolation of a building site, the wall element comprising:

two inner columns, each having a fixed support that is for holding a wall panel and that is a continuous profile extending along the inner column;

a first wall panel arranged between the fixed supports of the inner columns;

two outer columns partially surrounding the two inner columns, each of the outer columns having a fixed support for holding a wall panel; and a second wall panel arranged between the fixed supports of the outer columns, wherein:

the two inner columns and the two outer columns are configured to be moved relative to each other in the longitudinal direction of the columns so as to adjust the length of the wall element to match a room height of the building site to be isolated, and the wall element further comprises at least one spring that is arranged to exert a force between the two inner columns and the two outer columns to move the columns relative to each other in the longitudinal direction so as to secure the wall element between a floor and a ceiling.

2. The wall element according to claim 1, wherein the first wall panel and the second wall panel comprise cellular board.

3. The wall element according to claim 2, wherein the cellular board is a polycarbonate cellular board having a thickness between 6 and 32 millimeters.

4. The wall element according to claim 1, wherein:

the fixed supports of the inner and the outer columns are arranged to house wall panels of different thicknesses, and gaskets are arranged between the fixed supports and the wall panels to secure the wall panels to the fixed supports.

5. The wall element according to claim 1, further comprising a non-slip surface on outer surfaces that are arranged to be placed against the floor or the ceiling.

6. The wall element according to claim 1, further comprising a guide for partially accommodating a column of a neighbouring wall element so as to obtain a continuous wall from multiple neighbouring wall elements.

7. The wall element according to claim 1, further comprising a felt gasket or a felt seal fixed to the first wall panel or to the second wall panel and arranged to seal a gap between the first wall panel and the second wall panel in a dust proof manner.

8. The wall element according to claim 1, wherein the at least one spring is arranged to be operated with a lever.

9. The wall element according to claim 1, wherein the at least one spring is a pneumatic spring.

10. The wall element according to claim 1, wherein each fixed support of the inner columns extends along substantially the whole length of the inner column.

* * * * *